US006187520B1

(12) United States Patent
Pich et al.

(10) Patent No.: US 6,187,520 B1
(45) Date of Patent: Feb. 13, 2001

(54) PHOTOGRAPHIC HIGH CONTRAST SILVER HALIDE MATERIAL AND METHOD OF PROCESSING

(75) Inventors: Julia Pich, Rickmansworth; Roger H. Piggin, Abbots Langley; Mark L. Magill, Harrow, all of (GB)

(73) Assignee: Eastman Kodak Company, Rochester, NY (US)

( * ) Notice: Under 35 U.S.C. 154(b), the term of this patent shall be extended for 0 days.

(21) Appl. No.: 09/335,589

(22) Filed: Jun. 18, 1999

(30) Foreign Application Priority Data

Jul. 1, 1998 (GB) ..... 9814306

(51) Int. Cl.[7] ..... G03C 5/29
(52) U.S. Cl. ..... 430/434; 430/963
(58) Field of Search ..... 430/434, 963

(56) References Cited

U.S. PATENT DOCUMENTS

| | | | |
|---|---|---|---|
| 4,030,925 | 6/1977 | Leone et al. | 430/217 |
| 4,031,127 | 6/1977 | Leone et al. | 558/412 |
| 4,278,748 | 7/1981 | Sidhu et al. | 430/212 |
| 4,323,643 | 4/1982 | Mifune et al. | 430/441 |
| 4,618,574 | 10/1986 | Cavallaro | 430/567 |
| 4,947,354 | 8/1990 | Hethuin | 364/562 |
| 5,028,516 * | 7/1991 | Mukunoki | 430/963 |
| 5,232,823 * | 8/1993 | Morimoto et al. | 430/963 |
| 5,316,889 | 5/1994 | Sakai | 430/264 |
| 5,723,267 | 3/1998 | Ito | 430/399 |
| 5,766,833 | 6/1998 | Suematsu et al. | 430/399 |

FOREIGN PATENT DOCUMENTS

| | | |
|---|---|---|
| 0 333 435 | 12/1995 | (EP) . |
| 0 758 761 | 2/1997 | (EP) . |
| 0 849 623 A2 | 6/1998 | (EP) . |

* cited by examiner

*Primary Examiner*—Hoa Van Le
(74) *Attorney, Agent, or Firm*—J. Lanny Tucker; Edith A. Rice

(57) ABSTRACT

A high contrast photographic material free from nucleating agents comprising a support bearing a silver halide emulsion layer comprising silver halide grains and a hydrophilic colloid having a silver:hydrophilic colloid ratio above 1.9, and containing a density enhancing amine compound in the emulsion layer or an adjacent hydrophilic colloid layer wherein at least 60% of the silver halide grains are spectrally sensitized. A photographic image can be formed from the imagewise exposed material by a method comprising developing the exposed material for a time no longer than 25 seconds at a temperature no greater than 35° C.

5 Claims, No Drawings

PHOTOGRAPHIC HIGH CONTRAST SILVER HALIDE MATERIAL AND METHOD OF PROCESSING

FIELD OF THE INVENTION

The invention relates to high contrast photographic silver halide materials, particularly those of the graphic arts type, and to a method of processing such materials.

BACKGROUND OF THE INVENTION

For many years the very high contrast photographic images needed in the graphic arts and printing industries were obtained by developing a 'lith' emulsion (usually high in silver chloride content) in a hydroquinone, low sulfite, 'lith' developer by the process known as infectious development. High contrasts were achieved. However, such low sulfite developers are inherently unstable and are particularly inappropriate for machine processing.

Machine processing of graphic arts materials was achieved by the use of so called 'rapid access' high contrast materials which have a toe (lower scale) contrast below 3 and typically about 2, good process latitude and good process stability. Such materials are easy to use but this is at the expense of noticeably reduced dot quality hence they are not suitable for users requiring the highest of dot qualities. These materials are, however, well accepted and widely used and are in daily use alongside nucleated products described immediately below.

Conventional rapid access films require high silver coverage to achieve the densities required e.g. for contact onto printing plates. The use of such high silver laydowns requires long development times, greater than 24s and high temperatures, greater than 34° C. to ensure that all the material is fully developed and fixed.

To achieve the high image quality obtainable with lith processing and yet increase the stability of the process, emulsions containing nucleating agents, for example, hydrazides, have been used and processed in a high pH (about pH 11.5) developer with conventional amounts of sulfite, hydroquinone and possibly metol or a pyrazolidone.

A further improvement in the area of high contrast materials was the introduction of a lower pH process (below pH 11) using hydrazides active at this low pH together with the use of a contrast booster compound, for example, one of the boosters described in U.S. Pat. No. 5,316,889 or an amine booster as described in U.S. Pat. No. 4,947,354. The hydrazides proposed for use in such materials are described, for example, in U.S. Pat. No. 4,278,748, U.S. Pat. No. 4,031,127, U.S. Pat. No. 4,030,925 and U.S. Pat. No. 4,323,643 and in EP-A-0 333 435.

The use of incorporated nucleators, for example hydrazides, is not ideally desirable because the process sensitivity is still substantially worse than that obtainable in the rapid access process. This is because nucleation is a 2-phase process, an initial slow induction process followed by a rapid infectious development which will continue until all the silver is consumed or the coating is removed from the developer; hence the time of development and process activity must be controlled with great accuracy. In addition the mechanism of nucleation gives rise to chemical image spread which increases the size of exposed images and can give rise to spontaneous areas of density known as 'pepper fog'.

Nucleated coatings may contain less silver than the rapid access materials but the induction period also prohibits short access times The infectious process phenomenon of 'co-development' [*The Journal of Photographic Science* vol. 23, no. 1, 1975, LONDON(GB), pages 23–31] is defined as the tendency for unexposed silver halide grains with no latent image to develop if they are in the near vicinity of developing grains which are fogged. No spectral sensitization is described. The extent of the co-development reported has been insufficient to make this little more than an interesting observation.

EP-A-0 758 761 describes a high contrast photographic material comprising a support bearing a silver halide emulsion layer which material is free from nucleating agents and has a silver:gelatin ratio above 1 characterized in that the emulsion layer comprises both silver halide grains which are spectrally sensitized and silver halide grains which are not spectrally sensitized, and contains a density enhancing amine compound in the emulsion layer or an adjacent hydrophilic colloid layer.

When such a material is imagewise exposed, the density of the silver halide layer can be enhanced by the co-development effect to give a substantial density gain enabling the production of a high contrast material which does not contain a nucleating agent.

The examples in EP-A-0 758 761 all cite a sensitized grain to unsensitized grain ratio of 20:80 as a means to minimize dye stain whilst achieving a boost in density. However, at short development times and low developer temperatures the examples cited would not deliver high speeds and densities and would not be considered acceptable for certain graphic arts applications.

The object of the present invention is to provide improved high contrast silver halide photographic materials which do not contain a nucleating agent having improved development latitude to allow shorter development times especially at lower developer temperatures.

SUMMARY OF THE INVENTION

According to the present invention there is provided a high contrast photographic material free from nucleating agents comprising a support bearing a silver halide emulsion layer comprising silver halide grains and a hydrophilic colloid having a silver:hydrophilic colloid ratio above 1.9 and containing a density enhancing amine compound in the emulsion layer or an adjacent hydrophilic colloid layer, wherein at least 60% of the silver halide grains are spectrally sensitized.

There is also provided a method of forming a photographic image from an imagewise exposed high contrast photographic material free from nucleating agents comprising a support bearing a silver halide emulsion layer comprising silver halide grains and a hydrophilic colloid having a silver:hydrophilic colloid ratio above 1.9 wherein at least 60% of the silver halide grains are spectrally sensitized which method comprises developing the exposed material in the presence of a density enhancing amine compound for a time no longer than 25 seconds at a temperature no greater than 35° C.

High densities are achieved with less silver even at lower development temperatures and shorter development times.

Shorter access times and lower temperatures can result in improved productivity and cost savings for the film user.

DETAILED DESCRIPTION OF THE INVENTION

The preferred range of silver:hydrophilic colloid ratio is from 1.9 to 5, more preferably from 2 to 3 and especially from 2.2 to 2.6.

Preferably from 80 to 100% of the silver halide grains are spectrally sensitized. In a particular embodiment of the invention, 100% of the silver halide grains are spectrally sensitized.

Preferably, one or more development modifier compounds are present in the emulsion layer or an adjacent hydrophilic colloid layer. Examples of suitable development modifier compounds include hydroquinone and 4-carboxymethyl-4-thiazoline-2-thione.

The amine density enhancing compounds are amines which when incorporated into a silver halide material containing both spectrally sensitized and non-spectrally sensitized silver halide grains cause a higher density to be obtained under the conditions of development intended for the product.

In one embodiment of the invention the amine density enhancer is an amine which comprises at least one secondary or tertiary amino group, and has an n-octanol/water partition coefficient (log P) of at least one, preferably at least three, and most preferably at least four, log P being defined by the formula:

$$\log P = \log \frac{[X_{octanol}]}{[X_{water}]}$$

wherein X is the concentration of the amino compound.

Preferably such an amine contains within its structure a group comprised of at least three repeating ethyleneoxy units. Examples of such compounds are described in U.S. Pat. No. 4,975,354. It is preferred that the ethyleneoxy units are directly attached to the nitrogen atom of a tertiary amino group.

Included within the scope of the amino compounds which may be utilized in this invention are monoamines, diamines and polyamines. The amines can be aliphatic amines or they can include aromatic or heterocyclic moieties.

Aliphatic, aromatic and heterocyclic groups present in the amines can be substituted or unsubstituted groups. Preferably, the amines are compounds having at least 20 carbon atoms.

In one embodiment the density enhancing amine has the general formula:

$$Y((X)n\text{–}A\text{–}B)m$$

wherein

Y is a group which adsorbs to silver halide,

X is a bivalent linking group composed of hydrogen, carbon, nitrogen and sulfur atoms, B is an amino group which may be substituted, an ammonium group of a nitrogen-containing heterocyclic group, mis 1, 2or 3 and n is 0 or 1, or the general formula:

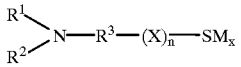

wherein $R^1$ and $R^2$ are each hydrogen or an aliphatic group, or $R_1$ and $R^2$ may together a ring, $R^3$ is a bivalent aliphatic group, X is a bivalent heterocyclic ring having at least one nitrogen, oxygen or sulfur atom as heteroatom, n is 0 or 1, and M is hydrogen or an alkali metal atom, alkaline earth metal atom, a quaternary ammonium, quaternary phosphonium atom or an amidino group, x is 1 when M is a divalent atom;

said compound optionally being in the form of an addition salt.

Preferred amino compounds for the purposes of this invention are bis-tertiary-amines which have a partition coefficient of at least three and a structure represented by the formula:

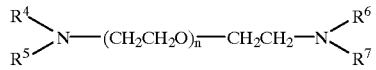

wherein n is an integer with a value of 3 to 50, and more preferably 10 to 50, $R^4$, $R^5$, $R^6$ and $R^7$ are, independently, alkyl groups of 1 to 8 carbon atoms, $R^4$ and $R^5$ taken together represent the atoms necessary to complete a heterocyclic ring, and $R^6$ and $R^7$ taken together represent the atoms necessary to complete a heterocyclic ring.

Another preferred group of amino compounds are bis-secondary amines which have a partition coefficient of at least three and a structure represented by the formula:

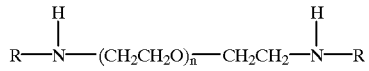

wherein n is an integer with a value of 3 to 50, and more preferably 10 to 50, and each R is, independently, a linear or branched, substituted or unsubstituted, alkyl group of at least 4 carbon atoms.

Particular amines suitable as density enhancers are listed in EP-A-0,364,166.

When the amine density enhancer is incorporated into the photographic material, it may be used in amounts of from 1 to 1000 mg/m$^2$, preferably from 10 to 500 mg/m$^2$ and, especially, from 20 to 200 mg/m$^2$.

In the method of the invention it is possible to locate the amine density enhancer in the developer rather than in the photographic material.

The spectrally sensitized grains can be bromoiodide, chlorobromoiodide, bromide, chloro-bromide, chloroiodide or chloride.

The non-spectrally sensitized grains can be bromoiodide, chloroiodide, chlorobromoiodide, bromide, chlorobromide, or chloride.

Both types of grain may also contain dopants as more fully described below.

Preferably both the spectrally sensitized and the non-spectrally sensitized grains comprise at least 50 mole percent chloride, preferably from 50 to 90 mole percent chloride based on total silver.

The size of the latent image-forming and non-latent image-forming grains preferably ranges independently between 0.05 and 1.0 $\mu$m in equivalent circle diameter, preferably 0.05 to 0.5 $\mu$m and most preferably 0.05 to 0.35 $\mu$m. The grain populations in the emulsion layer may have the same or differing grain sizes or morphologies.

In one embodiment of the present invention the grain size of the non-spectrally sensitized grains is smaller than that of the spectrally sensitized grains because, due to the covering power of small grains, the required density may be obtained with less silver halide.

As is known in the graphic arts field the silver halide grains may be doped with Rhodium, Ruthenium, Iridium or other Group VIII metals either alone or in combination. The grains may be mono- or poly-disperse.

Preferably the silver halide grains are doped with one or more Group VIII metal at levels in the range $10^{-9}$ to $10^{-3}$, preferably $10^{-6}$ to $10^{-3}$, mole metal per mole of silver. The preferred Group VIII metals are Rhodium and/or Iridium.

In addition to graphic arts products the present materials may be black-and-white non-graphic arts photographic materials needing moderate contrasts, for example, microfilm and X-ray products.

The emulsions employed and the addenda added thereto, the binders, supports, etc. may be as described in Research Disclosure Item 308119, December 1989 published by Kenneth Mason Publications, Emsworth, Hants, United Kingdom.

The hydrophilic colloid may be gelatin or a gelatin derivative, polyvinylpyrrolidone or casein and may contain a polymer. Suitable hydrophilic colloids and vinyl polymers and copolymers are described in Section IX of Research Disclosure Item 308119, December 1989 published by Kenneth Mason Publications, Emsworth, Hants, United Kingdom. Gelatin is the preferred hydrophilic colloid.

The present photographic materials may also contain a supercoat hydrophilic colloid layer which may also contain a vinyl polymer or copolymer located as the last layer of the coating (furthest from the support). It may contain some form of matting agent.

The vinyl polymer or copolymer is preferably an acrylic polymer and preferably contains units derived from one or more alkyl or substituted alkyl acrylates or methacrylates, alkyl or substituted alkyl acrylamides or acrylates or acrylamides containing a sulfonic acid group.

The present emulsion layer is preferably formed by sensitizing an emulsion with a dye and then, if required, combining the spectrally sensitized emulsion with a non-spectrally sensitized emulsion. Preferably the sensitizing dye is chosen so that it does not become desorbed from said spectrally sensitized grains. The blending can be done immediately before coating but this is not necessary as the present blended emulsions are typically stable for at least 20 minutes at coating temperatures.

Two emulsion components can be used where the first component is a "causer" emulsion which is a normal i.e. chemically and spectrally sensitized component coated in the range 60 to 100%, preferably 80 to 100% by weight of the total silver laydown. The requirements for the second "receiver" emulsion component are that it be clean, i.e. free of fog, and be capable of being developed by the enhanced co-development process.

Where a particular spectral sensitization requires the use of compounds not necessary in the other emulsion components of the coating, the laydown of these compounds may be reduced. This reduction will lead to cost savings. These compounds may further have undesirable properties, such as high UV Dmin, and their effect can be reduced.

As the speed of the non-spectrally sensitized emulsion is not critical to the final photographic speed of the coated product this emulsion does not require chemical sensitization and thus the production of this component requires fewer steps in the manufacturing process and less stringent quality control leading to manufacturability and cost benefits.

As the maximum density of the material is not primarily dependant upon latent image-forming grains, the invention has the advantage that imaging emulsions of grain size above those used in standard high contrast coatings can be used without the need to increase the overall silver laydown.

The sensitizing dye may have one of the general formulae:

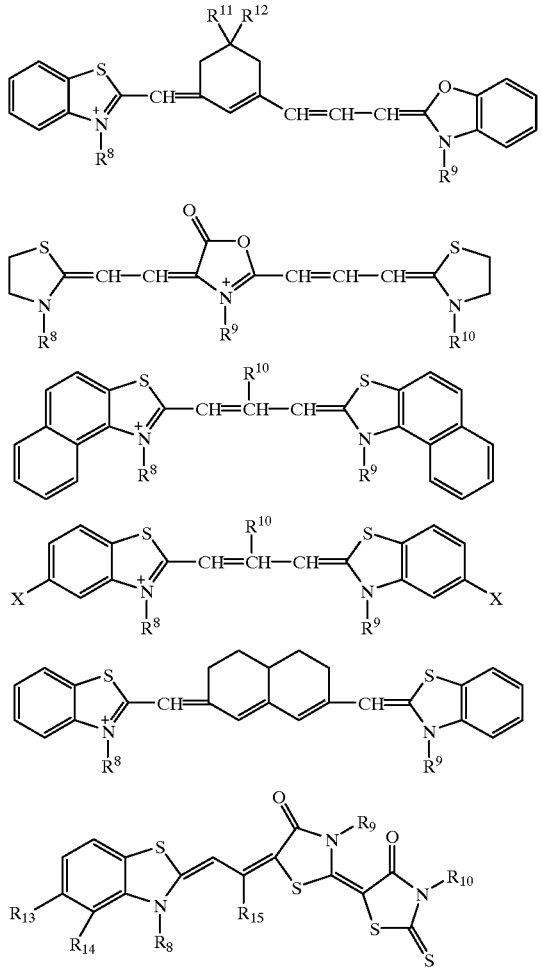

wherein $R^8$, $R^9$ and $R^{10}$ represent an alkyl group which may be substituted, for example with an acid water-solubilizing group, for example a carboxy or sulfo group, $R^{11}$ and $R^{12}$ represent an alkyl group of 1–4 carbon atoms, $R^{13}$, $R^{14}$ and $R^{15}$ represent H, substituted or unsubstituted alkyl or substituted or unsubstituted aryl, and X is a halogen, for example chloro, bromo, iodo or fluoro.

The present photographic materials preferably contain an antihalation layer on either side of the support. Preferably it is located on the opposite side of the support from the emulsion layer. In a preferred embodiment an antihalation dye is contained in the hydrophilic colloid underlayer. The dye may also be dissolved or dispersed in the underlayer. Suitable dyes are listed in the Research Disclosure mentioned above.

The light-sensitive silver halide contained in the photographic elements can be processed following exposure to form a visible image by associating the silver halide with an aqueous alkaline medium in the presence of a developing agent contained in the medium or the element. It is a distinct advantage of the present invention that the described photographic elements can be processed in conventional developers as opposed to specialized developers conventionally employed in conjunction with lithographic photographic elements to obtain very high contrast images.

Development modifiers incorporated in the photographic material may be used to enhance the practical performance of the film, improving image quality and linearity.

Examples of suitable development modifier compounds include hydroquinone and carboxylalkyl-3H-thiazoline-2-thiones having the formula

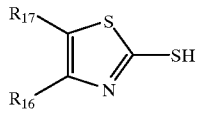

wherein one of $R_{16}$ and $R^{17}$ is a carboxyalkyl substituent containing an alkylene linking moiety and a carboxy moiety, which can be in the form of a free acid or a salt, such as an alkali metal or ammonium salt. The alkylene linking moiety preferably contains 1 to 6 carbon atoms, most preferably 1 carbon atom. The remaining $R_{16}$ or $R^{17}$ is hydrogen, a substituted or unsubstituted alkyl group having from 1 to 10 carbon atoms or a substituted or unsubstituted aryl group having from 6 to 12 carbon atoms.

Exemplary preferred carboxylalkyl-3H-thiazoline-2-thiones include:

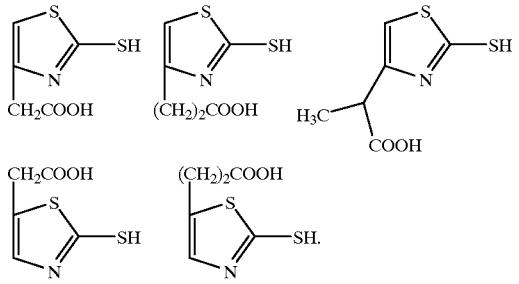

Specific compounds used in the following Examples include 4-carboxymethyl-4-thiazoline-2-thione (compound DM1) and hydroquinone (compound DM2).

Compound DM1 =

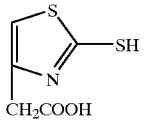

DM1 is preferably present in an amount from 1 to 10 mg/m$^2$, more preferably 2 to 7 mg/m$^2$ and even more preferably 3 to 5 mg/m$^2$ Compound DM2 =

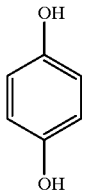

DM2 is preferably present in an amount from 20 to 200mg/m$^2$, more preferably 100 to 150 mg/m$^2$.

The developers are typically aqueous solutions, although organic solvents, such as diethylene glycol, can also be included to facilitate the solution of organic components. The developers contain one or a combination of conventional developing agents, such as a polyhydroxybenzene, aminophenol, para-phenylenediamine, ascorbic acid, pyrazolidone, pyrazolone, pyrimidine, dithionite, hydroxylamine or other conventional developing agents.

It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulphate can be incorporated into the developer. Chelating and sequestering agents, such as ethylenediaminetetraacetic acid or its sodium salt, can be present. Generally, any conventional developer composition can be employed in the practice of this invention. Specific illustrative photographic developers are disclosed in the Handbook of Chemistry and Physics, 36th Edition, under the title "Photographic Formulae" at page 3001 et seq. and in Processing Chemicals and Formulas, 6th Edition, published by Eastman Kodak Company (1963). The photographic elements can, of course, be processed with conventional developers for lithographic photographic elements, as illustrated by U.S. Pat. No. 3,573,914 and UK Patent No. 376,600.

Conventional rapid access films require high silver coverage to achieve the densities required for contact onto printing plates etc. The use of such high silver laydowns requires long development times, at least 25s and high temperatures, at least 35° C. to ensure that all the material is fully developed and fixed. In contrast, the photographic materials of the invention have improved development latitude which allows shorter development times, especially at lower development temperatures.

Exposed materials of the invention may be developed for a time no longer than 25 seconds at a temperature no greater than 35° C.

Preferably, materials of the invention are developed for a time no longer than 20 seconds, more preferably 15 seconds.

Preferably, materials of the invention are developed at a temperature no greater than 32° C., more preferably no greater than 30° C.

The present photographic materials are particularly suitable for exposure by red or infra-red laser diodes, light emitting diodes or gas lasers, e.g. a Helium/Neon or Argon laser.

The invention is further described by way of example in the Examples given below.

The photosensitive materials used in the following Examples were comprised of three layers coated on a polyethylene terephthalate base having an antihalation pelloid layer designed to absorb red light. Starting with the layer nearest the base, the three layers consisted of a layer comprising a spectrally sensitized emulsion and a non-spectrally sensitized emulsion, a gel interlayer and a gel supercoat layer.

The spectrally sensitized or dyed emulsion melt consisted of a 70:30 chlorobromide cubic monodispersed emulsion (0.22 $\mu$m edge length) doped with ammonium hexachlororhodate. Addenda included in this emulsion melt were sensitizing dye S1 of the formula

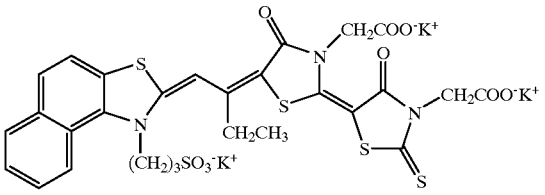

Dye: S1 at 150 mg/mole, potassium iodide at 250 mg/mole, with a suitable anti-foggant package and thickening agent polystyrene sulphonate for improved coatability.

The undyed emulsion melt consisted of a 70:30 chlorobromide cubic monodispersed emulsion (0.18 μm edge length) doped with ammonium hexachlororhodate. Addenda included in this emulsion melt were anti-foggants and thickening agent polystyrene sulphonate.

Other addenda coated in either the emulsion layer, interlayer or supercoat included the density enhancing amine of the formula:

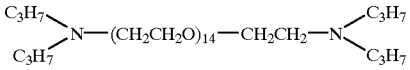

at 60 mg/M$^2$ and hydroquinone at 133 mg/M$^2$, plus a latex copolymer.

The interlayer was coated at a gel laydown of 1 g/m$^2$ and the supercoat at 0.488 g/m$^2$. Both layers contained surface-active ingredients to aid coating and the supercoat also contained matting beads.

A three layer comparative light sensitive material was also prepared comprising a spectrally sensitized emulsion layer, gel interlayer and supercoat. The emulsion consisted of a 70:30 chlorobromide cubic monodispersed emulsion (0.22 μm edge length) doped with ammonium hexachlororhodate and coated at 4 g/m$^2$ with gel laydown of 2.2 g/m$^2$ (silver to gel ratio=1.8). The emulsion was spectrally sensitized, and contained an appropriate antifoggant package and a latex copolymer. The interlayer was coated at a gel laydown of 0.65 g/m$^2$ and contained a latex copolymer. The supercoat was coated at 0.5 g/m$^2$and contained a latex copolymer, surface active chemicals to aid coating and a suitable matting agent.

For photographic evaluation the coatings were exposed using a helium neon laser attenuated to give an incremental step exposure of 0.08. The coatings were then processed through Kodak RA2000 developer, diluted 1+2 with water, fixed using Kodak 3000 fix, diluted 1+3 with water, washed and dried in a Colenta Imageline 43s processor. Development times varied from 15 to 40s and development temperatures from 28° C. to 32° C. The speeds were measured at densities 0.6 and 4 above fog and practical densities were calculated from the density measurements taken.

EXAMPLE 1

A coating was prepared in the manner described above, wherein the silver laydown of the dyed emulsion was 1.98 g/m and the silver laydown of the undyed emulsion melt was 1.32 g/m$^2$ both with silver to gel ratios of 2.36. This coating and a comparative sample were exposed and processed through RA2000 1+2 at 32° C. and the speed and density points measured. The results are shown in Table 1.

TABLE 1

| Development Time | Invention | | Comparative sample | |
|---|---|---|---|---|
| (s) | Speed | Density | Speed | Density |
| 15 | 0.56 | 4.4 | 0.26 | 2.8 |
| 20 | 0.58 | 4.4 | 0.41 | 3.1 |
| 30 | 0.60 | 4.5 | 0.49 | 3.3 |
| 40 | 0.66 | 4.9 | 0.55 | 3.5 |

As can be seen from Table 1 the invention achieves higher densities than the comparison with less silver and also develops faster to achieve these high densities at short development times.

EXAMPLE 2

The ratio of dyed to undyed emulsion was changed whilst maintaining a constant silver laydown. Coatings were prepared as described above differing only in the ratio of dyed to undyed grains. The coatings were processed through RA2000 1+2 at 32° C. and the speed and density points measured. The results are shown in Table 2.

TABLE 2

| Dyed emulsion (%) | Speed | Density |
|---|---|---|
| 20 | 152 | 3.1 |
| 50 | 201 | 4.2 |
| 60 | 210 | 4.5 |
| 80 | 212 | 4.8 |
| 100 | 216 | 5.0 |

From Table 2 it can be seen that increasing the dyed percentage of the layer results in increases in both speed and density. However, the greatest improvement is achieved by ensuring that at least 60% of the emulsion layer is dyed. While the data indicates that the preferred option for speed and density would be to coat 100% dyed emulsion grains, acceptable results with reduced dye stain may be obtained if only 60% of the emulsion is fully dyed.

EXAMPLE 3

A coating was prepared in the manner described above wherein all the emulsion grains were fully dyed, the silver to gel ratio was 2.36 and the density enhancing amine was present at 60 mg/m$^2$. The material of the invention and the comparative sample were both processed through Kodak RA2000 developer at 28° C. The results are shown in Table 3.

TABLE 3

| | Invention | | | Comparative | | |
|---|---|---|---|---|---|---|
| Development time (s) | Speed at 0.6 | Speed at 4 | Density | Speed at 0.6 | Speed at 4 | Density |
| 15 | 1.05 | 0.62 | 3.77 | 0.52 | 0.00 | 2.41 |
| 20 | 1.06 | 0.67 | 4.13 | 0.55 | 0.00 | 2.80 |
| 30 | 1.09 | 0.73 | 4.40 | 0.58 | 0.08 | 3.34 |
| 40 | 1.10 | 0.76 | 4.72 | 0.60 | 0.16 | 3.63 |

From Table 3 it can be seen that whilst the comparative sample has sufficient speed in the toe region it is not capable, at this low temperature, to fully develop the silver to allow a measure of speed at 4 above fog. In contrast, the material of the invention is capable of producing high densities even at 20s.

EXAMPLE 4

Important factors in this invention are the silver to gel ratio and the presence/absence of the amine density-enhancing compound. As can be seen from Table 4 below the coating with the high silver to gel ratio develops to higher Densities than the lower ratio coating, resulting in faster shoulder speeds and Higher practical densities whilst maintaining toe speed. In Table 5 it can be seen That omission of the amine results in less speed and lower densities compared to The inventive sample

TABLE 4

(Development at 28° C.)

| Development | Invention Silver:gel = 2.36 | | | Comparison Silver:gel = 1.50 | | |
|---|---|---|---|---|---|---|
| time (s) | Speed at 0.6 | Speed at 4 | Density | Speed at 0.6 | Speed at 4 | Density |
| 15 | 1.05 | 0.62 | 3.77 | 1.03 | 0.34 | 3.08 |
| 20 | 1.06 | 0.67 | 4.13 | 1.03 | 0.57 | 3.57 |
| 30 | 1.09 | 0.73 | 4.4 | 1.06 | 0.65 | 3.91 |
| 40 | 1.10 | 0.76 | 4.72 | 1.07 | 0.7 | 4.49 |

TABLE 5

(Development at 28° C.)

| Development | Invention Plus amine | | | Comparison Minus amine | | |
|---|---|---|---|---|---|---|
| time (s) | Speed at 0.6 | Speed at 4 | Density | Speed at 0.6 | Speed at 4 | Density |
| 15 | 1.05 | 0.62 | 3.77 | 0.98 | 0.43 | 3.24 |
| 20 | 1.06 | 0.67 | 4.13 | 0.98 | 0.53 | 3.69 |
| 30 | 1.09 | 0.73 | 4.4 | 1.02 | 0.62 | 3.95 |
| 40 | 1.10 | 0.76 | 4.72 | 1.01 | 0.65 | 4.33 |

EXAMPLE 5

Coatings were prepared in the manner described above differing only in the levels of development modifier compounds DM1 and DM2. The coatings were exposed on a Linotronic 330 imagesetter and processed through RA2000 developer, diluted 1+2 for 20s at 35° C. Optimum exposure levels were determined as the exposure, which rendered a density of 4.2 in the 100% exposure patch. The midtone dot is then measured and the closer the dot is to 50%, the more linear the film is considered. Dot quality is a subjective measurement on a scale of 1 to 8, where 1 is unacceptable and 8 is acceptable. Factors taken into consideration when dot quality is determined are edge sharpness, edge smoothness, presence/absence of silver specks in the unexposed areas and dot gain on contacting.

TABLE 6

| Coating | Compound DM1 (mg/m$^2$) | Compound DM2 (mg/m$^2$) | Dot size (%) | Dot quality |
|---|---|---|---|---|
| A | 3.7 | 0 | 57 | 2 |
| B | 3.7 | 67 | 54 | 4 |
| C | 3.7 | 133 | 53 | 5 |
| D | 3.7 | 166 | 52 | 5 |
| E | 0 | 133 | 54 | 3 |
| F | 2.0 | 133 | 53 | 4 |
| G | 3.7 | 133 | 53 | 4 |
| H | 5.8 | 133 | 52 | 5 |

From Table 6 above it can be seen that as the level of compounds 1 or 2 are increased dot size decreases indicating more accurate reproduction of a mid tone dot. In addition to this the dot quality also improves with the highest levels rendering dots with smoother, less ragged edges and with less fringe.

The invention has been described in detail with particular reference to certain preferred embodiments thereof, but it will be understood that variations and modifications can be effected within the spirit and scope of the invention.

What is claimed is:

1. A method of forming a photographic image from an imagewise exposed high contrast photographic material free from nucleating agents comprising a support bearing a silver halide emulsion layer comprising silver halide grains and a hydrophilic colloid having a silver:hydrophilic colloid ratio above 1.9 wherein at least 60% of said silver halide grains are spectrally sensitized, said method comprising developing said exposed material in the presence of a density enhancing amine compound for a time no longer than 25 seconds at a temperature no greater than 35° C.

2. The method of claim 1 comprising developing said exposed material for a time no longer than 20 seconds.

3. The method of claim 2 comprising developing said exposed material for a time no longer than 15 seconds.

4. The method of claim 1 comprising developing said exposed material at a temperature no greater than 32° C.

5. The method of claim 1 comprising developing said exposed material at a temperature no greater than 30° C.

* * * * *